US005333437A

United States Patent [19]

Conti

[11] Patent Number: 5,333,437

[45] Date of Patent: Aug. 2, 1994

[54] ROTATIVE INSERTING UNIT FOR DOCUMENTS AND SHEETS OF PAPER, IN PARTICULAR FOR AUTOMATIC EQUIPMENT FOR THE PRINTING AND INSERTING OF SAID MATERIALS INTO ENVELOPES

[76] Inventor: Romano Conti, Via Piero della Francesca, 37 - Prato, Italy

[21] Appl. No.: 981,494

[22] Filed: Nov. 25, 1992

[30] Foreign Application Priority Data

Nov. 26, 1991 [IT] Italy ..... FI91A/278

[51] Int. Cl.[5] ..... B65B 5/08; B65B 35/26

[52] U.S. Cl. ..... 53/284.3; 53/381.3

[58] Field of Search ..... 53/284.3, 460, 385.1, 53/381.5

[56] References Cited

U.S. PATENT DOCUMENTS

| | | | |
|---|---|---|---|
| 1,794,517 | 3/1931 | Hellman | 53/381.5 X |
| 2,996,862 | 8/1961 | Johnson et al. | 53/389.1 X |
| 3,242,637 | 3/1966 | Wills | 53/284.3 |
| 4,020,615 | 5/1977 | Irvine et al. | 53/284.3 X |
| 4,471,598 | 9/1984 | Sanz | 53/284.3 |
| 4,817,369 | 4/1989 | Tribbey | 53/284.3 X |
| 4,852,334 | 8/1989 | Auerbach | 53/381.5 X |
| 4,888,938 | 12/1989 | Auerbach | 53/284.3 X |
| 4,962,623 | 10/1990 | Francisco | 53/284.3 X |

*Primary Examiner*—Horace M. Culver

*Attorney, Agent, or Firm*—Browdy and Neimark

[57] ABSTRACT

Rotative inserting unit for documents and sheets of paper for use, in particular, with automatic equipment for the printing and the inserting of said materials into envelopes. The unit comprises a drum (14) for the feeding of the already folded sheets, rotating intermittently, on the side surface (14*a*) of which transport seats are formed for the paper sheets, on subsequent angular portions of the surface, as well as fixed guide means (19) inside which said surface rotates. A conveyor (21) for the envelopes is also provided for, located at the exit of an automatic distributor box (24) of the envelopes and converging towards the exit of said guide means (19) in a position substantially tangent to the surface of said drum and in correspondence with the opening of a mobile pocket (33) for the temporary collection of the envelopes. There are further provided means (41) for lifting at least one edge delimitating the mouth of the envelope periodically contained inside said pocket in order to allow the insertion of the sheet exiting said guide means.

9 Claims, 2 Drawing Sheets

ROTATIVE INSERTING UNIT FOR DOCUMENTS AND SHEETS OF PAPER, IN PARTICULAR FOR AUTOMATIC EQUIPMENT FOR THE PRINTING AND INSERTING OF SAID MATERIALS INTO ENVELOPES

DESCRIPTION

1. Field of the Invention

The present invention relates to a rotative inserting unit for documents and sheets of paper, in particular for automatic equipment for the printing and inserting of said materials into envelopes.

2. Description of the prior art

Equipment for the continuous automatic printing of documents and sheets of paper and for folding and inserting them into envelopes is well known. Said equipment is ever more popular in firms, mainly of services, which produce a large volume of printed materials directed to distribution to a very vast body of consumers, such as banks, insurance companies, companies which operate in the field of mail-order sales, or also offices of public institutions and central and regional government administrations. Said equipment generally comprises a printing unit, for instance of a laser or ion type and the like, an inserting unit comprising a folding station for the sheets, a feeding station of the envelopes, a sheet inserting station and an envelope closing station. All operations which are carried out in the inserting unit are completed substantially on the same horizontal plane by the action of transport belts, pneumatic or magnetic actuators, diverting arms and lifting suckers.

The inserting unit can be physically separated from the printing unit, for example in a different department (the former in the secretary's office or the file room, the latter in the EDP center) or, advantageously, they can be assembled as a single continuous piece of equipment, such as that described in the Italian patent application for a utility model No. 11686B/90 in the name of the same applicant.

Even if, with the solution provided in said utility model, the production cycle and handling of the printed matter is rationalized considerably, the relative equipment proves to be of substantial bulk, mainly because of the considerable size of the inserting unit, and therefore is not very suitable for users which have limited space available and which do not need high capacity equipment.

The object of the present invention is to provide an inserting unit for automatically inserting documents and sheets of paper into envelopes having a structure different from that of the known inserting units in order to be more compact and allow the realization of printing and inserting equipment of considerably reduced size with respect to those presently used.

SUMMARY OF THE INVENTION

This result is accomplished with the inserting unit according to the present invention which is characterized by the fact that it comprises means for feeding the already folded sheets formed by an intermittently rotating drum on the side surface of which transport seats are formed for the sheets, located on subsequent angular portions of the surface, said surface being rotatively mounted inside fixed guide means. For the feeding of the envelopes a conveyor is provided for, positioned at the exit side of an envelope automatic distributor box, converging towards the exit side of said guide means in a position substantially tangent to the side surface of said drum and in correspondence with the inlet side of a mobile pocket for the temporary collection of the envelopes. Means are also provided for lifting at least one edge delimitating the mouth of the envelope periodically contained inside said pocket, in order to allow the insertion of the folded sheet exiting from said guide means. In this way the transport of the folded sheets and the envelopes towards the inserting unit, rather than exhibiting a bulky extension on a horizontal plane, as occurs presently, can be realized on more than one substantially vertically flanked plane. Similarly the inserting unit and the unit of discharge of the envelopes containing the folded sheet can be arranged substantially underneath the transport drum of the folded sheets, while the folding device for the sheets can be placed, at least in part, above the transport drum, thus saving considerable space.

BRIEF DESCRIPTION OF THE DRAWINGS

Further characteristics and advantages of the rotative inserting unit according to the present invention will be made apparent in the following description of one of its possible embodiments given as an example, but not limitative, with reference to the attached drawings, in which.

DESCRIPTION OF A PREFERRED EMBODIMENT

Figure 1:
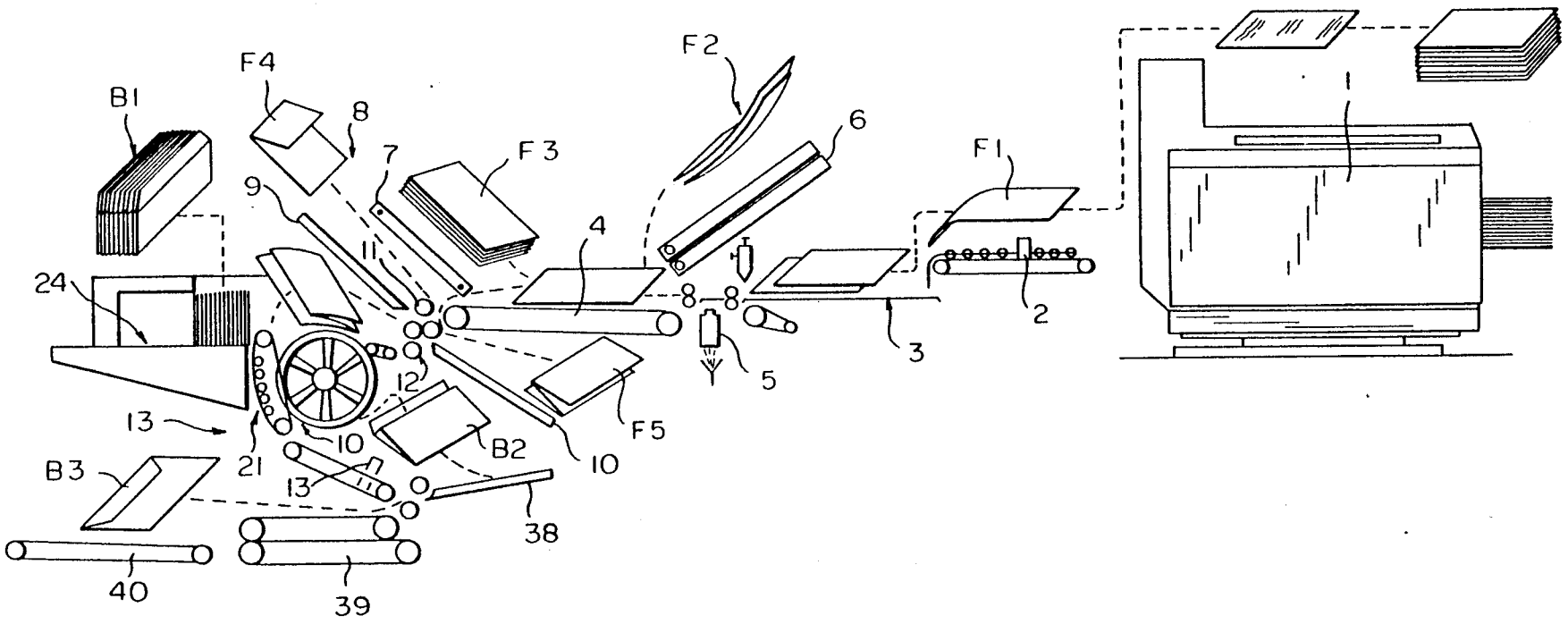
FIG. 1 shows in schematic form a piece of equipment for the printing of documents and inserting of them into envelopes incorporating the inserting unit according to the present invention.

With reference to FIG. 1, it has been indicated at 1 a printer of any known type for documents in sheets, and at 2 an interface between the printer 1 and the subsequent folding and inserting units, in practice constituted by transport means for the conveyance of the printed sheets F1 towards a sheet buffer plane 3 having the function of a storage unit in the equipment given the higher operating velocity of the printer 1 as compared to that of the folding and inserting units placed downstream.

From the buffer plane of 3 the sheets are drawn one at a time onto an aligning belt 4 after being passed through an optical scanning unit 5 by means of which special signs are read, indicated as examples along the edge of one of the sheets staying on the buffer plane 3, automatically printed on the last sheet of each group of sheets which must be inserted in the same envelope. As is apparent from the above, the aligning belt 4 operates discontinuously, feeding the sheets deposited on it towards the subsequent folding unit only after the marked sheet is passed through the optical scanning unit 5 and after other possible sheets F2, for instance preprinted dividers or end sheets, have been in their turn fed onto the aligning belt 4 by means of a special auxiliary side feeder 6. When the total number of sheets on the aligning belt 4 is higher than the maximum number of sheets compatible with the capacity of the envelopes available in the inserting unit, said group of sheets, indicated by F3, is sent to a manual inserting station, not shown, by means of a diverting plane 7 magnetically or pneumatically operated. At the end of the aligning belt 4 a sheet folding unit is installed, generically indicated by 8, of a conventional type and comprising two substantially opposed pockets 9 and 10 fit to accomplish, respectively, the first and second fold of the sheet or group of sheets, in a known way, with the aid of two pairs of rollers 11 and 12, interposed between said pockets. The sheet that has been subjected to the the first and to the second folding has been indicated by F4 and F5, respectively, in FIG. 1.

Figure 2:
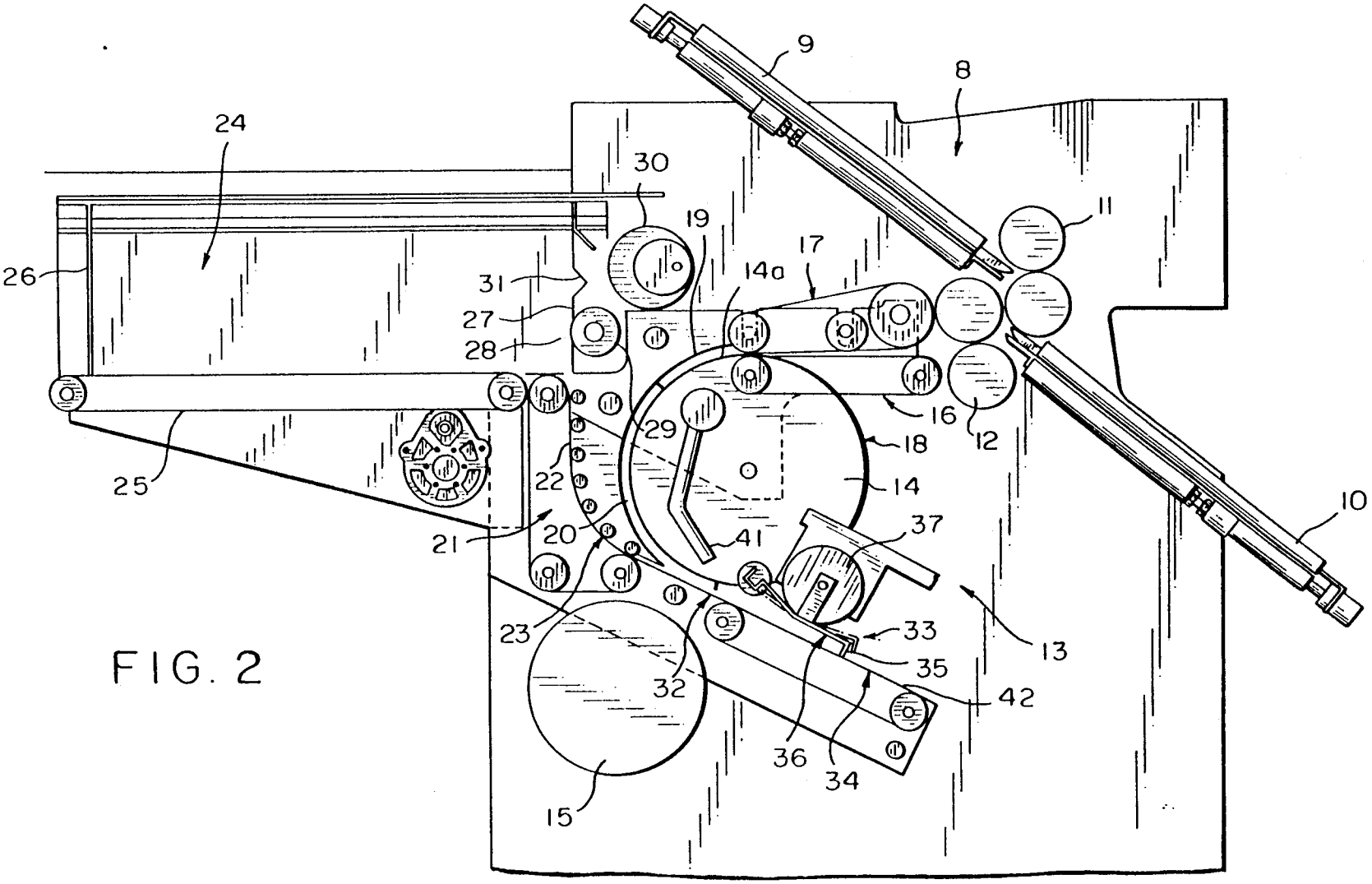
FIG. 2 shows in more detail and in a side view the inserting unit according to the present invention and the relative folding unit for documents associated with it.

With reference also to FIG. 2, the inserting unit, generically indicated by 13, comprises a drum 14 pivotally connected to the structure of the equipment and set in intermittent rotation by a motor 15. The drum 14 is situated downstream of the pairs of rollers 11 and 12 and at the exit side of a pair of transport belts 16 and 17 which slide in contact with one another in the same direction to feed the folded sheets F5 onto the side surface 14*a* of the drum 14. Three axial projections 18 extend from surface 14*a* to delimitate three surface portions of an angular width equal to 120° constituting three transport seats for the folded sheets F5 loaded by the pair of belts 16 and 17. Furthermore, the side surface 14*a* of the drum together with aa fixed case 19, coaxial to the drum 14 and having a semicircular cross section, define a guide duct 20 for the folded sheets F5. The entrance of the duct 20 is located in correspondence to the exit section of the feeding belts 16 and 17 which are tangent to the side surface 14*a* of the roller 14 in its upper part, whereas the exit of the duct 20 is situated substantially on the diemetrically opposed side of the drum 14. Towards the exit section of the duct 20 converges also a conveyor for the envelopes indicated generically by 21 and comprising a transport belt 22 and a plurality of small idle rollers 23 in contact with the belt to guide the envelopes B1 which are fed onto the belt 22. The feeding of the envelopes onto the conveyor 21 occurs by means of an automatic distributor 24, of a known type, comprising a belt 25, on which the envelopes are arranged in a flanked vertical position with their closing flap upward, opposite the belt 25, and an envelope pushing plate 26 sliding integral to the belt 25. The exit side of the automatic distributor 24 is delimitated on one side by the end of the belt 25 and on the other by a wall 27, opposing the envelope pushing plate 26. On the wall 27 a window 28 is formed through which faces a suction roller 29 operated by motor 30. The roller 29 pulls by suction an envelope towards the exit of the distributor 24 feeding it onto the conveyor 21 and more precisely arranging it between the belt 22 and the first of the small rollers 23. The wall 27 ends, above the window 28, with an outward protrusion 31, shaped substantially at right angle, which allows the lifting of the closing flap of the envelope which thus opens coplanar to the envelope itself as the latter slides along the wall 27.

The development of the active part of the belt 22 is generically inclined from the exit of the dristributor 24 to converge towards the exit of the guide duct 20 for the folded sheets F5. In particular the conveyor 21 is under the exit section of the distributor 24 and beside the drum 14, and its active part has an initial vertical length connected to a substantially arc-shaped length ending on a slide 32 on which converge alternately the other envelopes B1 and the folded sheets F5. At the end of the slide 32, substantially below the drum 14 a temporary collection pocket for the envelopes is provided for, indicated generically by 33, in which the inserting of the folded sheets into the envelopes occurs. More particularly, the pocket 33 comprises an intermittently moving plane 34, co-planar to the slide 32, and a mobile baffle 35, transverse to the direction of sliding, against which the envelope rests while waiting to be filled. The baffle 35 is pivoted to the structure of the equipment by means of an arm 36 and can be lifted by the operation of an electromagnetic device 37 in order to allow the envelope to advance on the plane 34, which is put in motion once the envelope has been filled. To open the envelope which periodically is found in the pocket 33, a nozzle 41 is provided for turned towards the mouth of the envelope to blow a jet of air towards it in an intermittent way lifting one edge and opening it while the folded sheet is inserted.

Advantegeously the mobile plane 34 is constituted by a transport belt 42, the starting and stopping of which is synchronized with the lifting and lowering of the baffle 33, the movements of which, in turn, are synchronized with the intermittent rotation of the drum 14.

The filled envelope B2 is discharged from the pocket 33 towards a subsequent pocket 38, shown in FIG. 1, for the folding of the closing flap, and the closed envelope B3 is sent to the collection and sorting sections, not shown, by further transport means 39 and 40, indicated schematically in FIG. 1.

Variations and/or modifications can be brought to the inserting unit for documents and sheets of paper according to the present invention, without departing from the scope of the invention itself.

I claim:

1. Rotative inserting unit for documents and sheets of paper, for automatic equipment for the printing and inserting of said materials into envelopes, comprising means for feeding folded sheets and means for feeding the envelopes to receive said sheets, said means for feeding the sheets comprising a drum (14) rotating intermittently, said drum including a side surface (14*a*) having at least three delimited transport seats for the sheets arranged on subsequent angular portions of the side surface, as well as fixed guide means (19) in which said surface rotates, said means for feeding the envelopes comprising an envelope conveyor (21), placed at an exit of an automatic distributor box (24) of the envelopes, said envelope conveyor (21) converging towards an exit of said guide means (19) in a position substantially tangent to the side surface (14*a*) of said drum (14) and in correspondence to an entry of a mobile temporary collecting pocket (33) of the envelopes, means (41) being provided for lifting at least one edge delimitating a mouth of the envelope periodically contained in said pocket (33), so as to allow insertion of a sheet exiting from said guide means (19).

2. Inserting unit according to claim 1, wherein on the side surface of said drum (14) at least three equally spaced longitudinal projections (18) are provided for angularly delimitating said envelope transport seats and said guide means comprises a case (19) of substantially semicircular shape, coaxial to said drum, extending from a transporter (17) for the load of said sheets to said seats to said mobile temporary collecting pocket (33) located on a side diametrically opposed said transporter (17) of sheets and under said drum (14).

3. Inserting unit according to claim 1, wherein said conveyor (21) of the envelopes comprises a transport belt (22) located under the distributor box (24) of the envelopes and extending beside said drum (14) with a substantially inclined path towards said pocket (33), and a plurality of small, idle rollers (23) in rotative contact with said belt for guiding the envelopes along said belt.

4. Inserting unit according to claim 3, wherein said belt (22) has a vertical section at the exit of said distributor box (24) connected to an arched section converging with said guide means of the sheet.

5. Inserting unit according to claim 1, wherein said collecting pocket (33), comprises a mobile plane (34), towards which converge said guide means and said conveyor (21) of the envelopes, and a baffle (35) in contact with said mobile plane (34) to act as a rest-ledge for envelopes fed into said pocket (33), said baffle (35) being rigidly connected to a mobile arm (36) angularly connected to means for accomplishing the lifting of said baffle to permit passage of said envelopes once they are filled.

6. Inserting unit according to claim 5, wherein said means of lifting is of a magnetic type.

7. Inserting unit according to claim 1, wherein said means for lifting at least one edge of the section of the opening of each envelope comprise a nozzle (41) blowing air towards said pocket (33).

8. Inserting unit according to claim 1, wherein said automatic distributor box (24) of the envelopes comprises a mobile plane (25), on which the envelopes are arranged vertically flanked, and means (26) for pushing the envelopes integral with said plane, as well as a wall (27) opposing said means and delimitating together with an end of said mobile plane an exit section for the envelopes, means (29) being provided for feeding each envelope from said exit section towards said envelope conveyor (21).

9. Inserting unit according to claim 8, wherein said means for feeding each envelope comprises a suction roller (26) operating through said wall (27) which, above said suction roller, has a substantially right-angled protrusion (31) for lifting of a closing flap of each envelope.

* * * * *